US009464633B2

(12) United States Patent
Allaire

(10) Patent No.: US 9,464,633 B2
(45) Date of Patent: Oct. 11, 2016

(54) SYSTEM FOR EXCLUDING PROCESS FLUID AND SOLIDS FROM SEALS AND BEARINGS OF AN AXIAL PUMP IN A LOOP REACTOR

(71) Applicant: Flowserve Management Company, Irving, TX (US)

(72) Inventor: Jason Douglas Allaire, Wells, ME (US)

(73) Assignee: Flowserve Management Company, Irving, TX (US)

( * ) Notice: Subject to any disclaimer, the term of this patent is extended or adjusted under 35 U.S.C. 154(b) by 240 days.

(21) Appl. No.: 14/275,175

(22) Filed: May 12, 2014

(65) Prior Publication Data

US 2015/0322968 A1 Nov. 12, 2015

(51) Int. Cl.

| | |
|---|---|
| ***F04D 7/00*** | (2006.01) |
| ***F04D 3/00*** | (2006.01) |
| ***F04D 29/06*** | (2006.01) |
| ***F04D 29/04*** | (2006.01) |
| ***F04D 29/041*** | (2006.01) |
| ***F04D 29/046*** | (2006.01) |
| ***F04D 29/70*** | (2006.01) |

(52) U.S. Cl.

CPC . *F04D 3/00* (2013.01); *F04D 7/00* (2013.01); *F04D 29/04* (2013.01); *F04D 29/041* (2013.01); *F04D 29/046* (2013.01); *F04D 29/061* (2013.01); *F04D 29/708* (2013.01)

(58) Field of Classification Search

CPC ..... F04D 29/708; F04D 3/00; F04D 7/00; F04D 29/061; F04D 29/04; F04D 29/041; F04D 29/046

USPC ..... 241/46.06, 121, 46.013, 46.11

See application file for complete search history.

(56) References Cited

U.S. PATENT DOCUMENTS

| | | | | |
|---|---|---|---|---|
| 4,840,384 | A * | 6/1989 | Dorsch | F04D 29/126 277/379 |
| 4,842,479 | A * | 6/1989 | Dorsch | F04D 7/045 415/121.1 |
| 8,109,714 | B2 * | 2/2012 | Keener | F04D 7/045 241/46.06 |
| 2005/0053461 | A1 * | 3/2005 | Doering | F04D 29/2288 415/121.1 |

* cited by examiner

*Primary Examiner* — Igor Kershteyn
*Assistant Examiner* — Aaron R Eastman
(74) *Attorney, Agent, or Firm* — Maine Cernota & Rardin

(57) ABSTRACT

A mechanical expelling mechanism for an axial pump system in a loop reactor includes straight or curved repelling vanes mounted to a vertical or tapered rear face of the impellor hub and a tapered wall provided in the adjacent seal housing. In combination, these elements exclude and eject process slurry, especially polymer solids, away from the seals and bearings, and thereby prevent damage to the seals and bearings, at least until a flow of flushing fluid can be restored. The repelling vanes further serve to circulate and exchange any process fluid and catalyst that remains in the space between the impellor and the seals, so that localized warming and run-away formation of polymer solids near the seals is avoided. The repelling vanes can be curved or straight. In embodiments, the repelling vanes reduce pump efficiency by less than 1%.

23 Claims, 9 Drawing Sheets

SYSTEM FOR EXCLUDING PROCESS FLUID AND SOLIDS FROM SEALS AND BEARINGS OF AN AXIAL PUMP IN A LOOP REACTOR

FIELD OF THE INVENTION

The invention relates to slurry polymerization in a liquid medium, and more particularly, to pumping apparatus for a loop reactor used for slurry polymerization.

BACKGROUND OF THE INVENTION

Polyolefins such as polyethylene and polypropylene may be prepared by particle form polymerization, also referred to as slurry polymerization. With reference to FIG. 1, in this technique, feed materials typically including a monomer and a catalyst are fed to a loop reactor 100, and a product slurry containing solid polyolefin particles in a liquid medium is taken off or withdrawn from the reactor 100.

With reference to FIGS. 2 and 3, in a loop polymerization operation, a fluid slurry is circulated around the loop reactor 100 using one or more pumps 102, typically axial flow pumps having impellers 200 disposed within elbow sections 104 of the reactor 100, the impellors having hubs 208 mounted on impellor shafts 202 that extend through the walls of the elbows 104 and are supported by one or more bearings 300. In some implementations, the bearings 300 are ball bearings that are coated by a lubricant introduced through a lubrication tube 204. In other implementations, the impellor shaft 202 is supported by a sleeve bearing 300 that is coated by a lubricant flowing axially along the impellor shaft 202. Still other implementations use other types of bearing(s) and lubrication. Note that the term "bearings" is used herein to refer generically to all suitable bearing and lubrication implementations, unless the specific context requires otherwise.

The fluid slurry is typically inhibited from reaching the bearings 300 by one or more mechanical seals 302 mounted in a seal housing 312. However, there is a danger that some of the fluid slurry and polymer solids might enter the space 306 between the impellor 200 and the seals 302, or the fluid might even leak past the mechanical seals 300 and react to form polymer solids in the space 304 between the seals 302 and the bearings 300, and so cause damage to the seals 302 and/or to the bearings 300.

Often, the reactor system 100 is configured to introduce the catalyst into the fluid slurry near one or more of the axial flow pumps, so that the action of the axial flow pump mixes the catalyst with the slurry as rapidly as possible. Unfortunately, this configuration can lead to higher than average catalyst concentrations in the immediate vicinity of the pump, and an enhanced likelihood that polymer solids may form in the space between impellor hub 208 and the seals 300, between the seals 300 and the bearings 302, or in a space within the bearing(s).

Since there is substantially no formation of polymer solids in the absence of the catalyst, it is of primary importance to exclude the catalyst from the spaces 304, 306 between the bearings 300 and seals 302 and between the seals 302 and the impellor hub 208. Typically, this is accomplished by providing a pressurized flow of a flushing fluid 308 through a flushing tube 206 into the space 306 between the seals 302 and the impellor 200, thereby forcing the catalyst out and away 310 from the impellor 200. Usually, the flushing fluid comprises one or more of the feed materials, but is devoid of catalyst. In similar implementations, for example when using a sleeve bearing, the flushing fluid typically flows down the shaft tube to the bearing(s).

However, it can happen from time to time that the flow of the pressurized flushing fluid 308 fails, for any of a number of reasons. If this happens, the reactor 100 must be stopped, and frequently it is necessary to service the bearings 300 and seals 302 if damage has occurred. For a typical polymer reactor operating in a commercial environment, such a loss of production while the reactor 100 is stopped can be very costly.

What is needed, therefore, is an apparatus that will at least temporarily exclude catalyst and polymer solids from the bearings and seals of an axial pump in a polymer loop reactor in the event of a failure in the flushing system.

SUMMARY OF THE INVENTION

A mechanical expelling mechanism for an axial pump system in a loop reactor includes repelling vanes that are rotationally synchronized with the impellor and are configured to exclude and expel process slurry, especially polymer solids, away from the seal(s) and bearing(s) and into the main flow of the process fluid. The repelling vanes further serve to circulate and exchange any process fluid and catalyst that remains in the space between the impellor and the seal housing, so that localized warming and run-away formation of polymer solids is avoided.

In embodiments, the seal housing includes a proximal side wall nearest to the impellor that is vertical and flat. In other embodiments the proximal side wall of the seal housing comprises an inwardly tapered surface that directs centrifugally circulating fluid and polymer solids away from the seals and toward the main flow of the process slurry. The inwardly tapered surface can include only an inner portion of the seal housing proximal side wall, or the entire proximal side wall of the seal housing can be tapered inward.

In certain embodiments, the repelling vanes are vertical, and in some of these embodiments the repelling vanes are fixed to a vertical rear face of the impellor hub. In other embodiments, a tapered male element is included that fills most of the space between the impellor and the seal housing. The tapered male element can be a tapered rear portion of the impellor hub, a section of the impellor shaft, or a separate element attached to the impellor shaft, the outer tapered surface of the male element can have a shape that is complementary to a tapered inner surface of the seal housing. This approach minimizes the space between the proximal surface of the bearing housing and the impellor, and avoids the formation of "stall" areas therein where the slurry is not rapidly exchanged. Due to the ongoing chemical reaction, if stall areas are allowed to form, there may be a danger that localized heating will occur that could lead to run-away formation of solids near the seal(s).

If the mechanical expelling mechanism of the present invention is used in combination with a traditional, pressurized flushing system that circulates catalyst-free flushing fluid through the seal housing, and if the flushing fluid remains available to the system even if it loses its pressurization, due for example to a failure of a flushing pump or a leak in the system, then at least until the pressurized flushing system can be restored to normal operation, the mechanical expelling mechanism of the present invention will effectively function as a centrifugal flushing pump that will continue to circulate flushing fluid through the seal housing so that the heavier particles of catalyst and polymer solids are separated and expelled away from the seal(s) and bearing(s) and into the main flow of the process slurry, and so that any process fluid and catalyst that remains in the space between the impellor and the seals is rapidly exchanged with fluid from the main process flow, so that localized warming and run-away formation of polymer solids near the seals is avoided.

On the other hand, if the present invention is implemented without a traditional pressurized flushing system, or if a pressurized flushing system is provided but the flushing fluid is blocked or otherwise not available due to some failure, then the mechanical expelling mechanism of the present invention will nevertheless operate to exclude polymer solids from the seals and bearings due to two separate mechanisms. First, the repelling vanes will physically eject polymer solids away from the seals and out into the main flow of the process slurry. Second, the repelling vanes will force the fluid near the seals to rapidly circulate and exchange with the fluid in the main process flow, so that localized heating due to the ongoing chemical reaction and run-away formation of solids near the seals will be avoided.

In embodiments, the mechanical expelling mechanism of the present invention reduces the pumping efficiency by less than 1%.

While some embodiments of the present invention are described herein as including repelling vanes on a tapered rear face of the impellor hub, surrounded by a corresponding inwardly tapered face of the seal housing, it should be understood that any combination of elements that provides the mechanical configuration and functionality described herein falls within the scope of the invention. For example, the repelling vanes can be vertical and fixed to a vertical rear surface of the impellor hub, or they can be slanted and fixed to a tapered section of the impellor hub adjacent to the rear face of the impellor, or the repelling vanes can be provided on a separate, tapered piece attached to the impellor shaft just behind the impellor hub. Similarly, the corresponding surface that abuts and/or surrounds the repelling vanes need not be provided by the seal housing, but can be provided by a separate piece or by appropriate configuration of some other element in the system.

Note that the term "tapered curve" is used herein to describe any curve that has monotonically varied amplitude along a longitudinal axis, with a maximum at one end and a minimum at the other end. Similarly, the term "tapered surface" is used herein to describe the three-dimensional shape that is formed when a tapered curve is rotated about its longitudinal axis.

It should further be understood that the present invention is not limited to axial pumps, nor to polymer loop reactors, but includes any style of pump having an impellor that is exposed to a process fluid while solids are being formed in the fluid by a chemical reaction.

Similarly, the invention is not limited to any particular type of bearings, but can include ball bearings, sleeve bearings, or any other type of suitable bearings, or any combination thereof, and any appropriate type of lubrication. Accordingly, the terms "bearing" and "seal" are used generically herein to refer to any suitable types and quantities of bearings and seals. Also, the terms refer to both the singular and the plural, depending on the embodiment. In other words, the terms "bearings" and "seals" do not imply that a plurality of bearings or seals is provided in all embodiments, nor do the terms "bearing" and "seal" imply that only one bearing or one seal is included in all embodiments.

Once general aspect of the present invention is a system for inhibiting process solids from entering a protected region of a pumping apparatus. The system includes an impellor shaft, an impellor surrounding and rotationally fixed to the impellor shaft, a protected region located proximal to the impellor shaft behind the impellor a male element surrounding and rotationally synchronized with the impellor shaft between the protected region and the impellor, an outer surface of the male element having a tapered diameter that is largest at a proximal end thereof nearest to the impellor, a female element surrounding the impellor shaft between the protected region and the male element, an inner surface of the female element having a tapered diameter that is largest at a proximal end thereof nearest to the impellor, a flushing space being formed between the inner surface of the female element and the outer surface of the male element, and a plurality of repelling blades rotationally fixed to the outer surface of the male element and located within the flushing space, the repelling blades being circumferentially spaced apart about the outer surface of the male element and configured to centrifugally circulate process solids in the flushing space, so that the process solids are driven axially toward the impellor and away from the protected region.

In embodiments, the protected region contains at least one of a seal and a bearing cooperative with the impellor shaft. In some embodiments the male element is a tapered rearward extension of the impellor. In other embodiments, the male element is a tapered section of the impellor shaft. In various embodiments the male element is distinct from the impellor and from the impellor shaft. In certain embodiments, the female element is a section of a bearing housing containing a bearing that supports the impellor shaft.

In representative embodiments, the female element is a section of a seal housing containing a seal configured to inhibit leakage of fluid between the seal and the impellor shaft. In some embodiments, wherein the system is able to exclude process solids from the protected region while the process solids are being formed in a reactive process fluid. And in certain embodiments, the repelling blades are straight. In other embodiments, the repelling blades are curved.

Various embodiment further include a flushing tube configured to inject a flow of flushing fluid into the flushing space so as to drive process solids away from the protected region, wherein the system is able to exclude process fluids from the protected region during a stoppage of the flow of flushing fluid. In some of these embodiments, the system is able to prevent the process solids from damaging elements in the protected region during a stoppage of the flow of flushing fluid for a duration of at least 15 minutes. In other of these embodiments, the system is able to prevent the process solids from damaging elements in the protected region during a stoppage of the flow of flushing fluid for a duration of at least 24 hours.

And in various embodiments, the system does not require injecting a flow of flushing fluid into the protected region so as to prevent the process solids from damaging elements in the protected region.

Another general aspect of the present invention is a method for inhibiting process solids from entering a protected region of a pumping apparatus. The method includes providing an impellor surrounding and rotationally fixed to an impellor shaft, a protected region being located proximal to the impellor shaft behind the impellor, providing a plurality of repelling blades rotationally synchronized with the impellor and located between the impellor and the protected region, providing a bounding element surrounding the impellor shaft between the protected region and the repelling blades, a flushing space being formed between a proximal surface of the bounding element and the impellor, and causing the impellor shaft to rotate, thereby rotating the repelling blades and centrifugally circulating process solids in the flushing space, so that the process solids are driven away from the protected region.

In some embodiments, the repelling blades are vertical. In other embodiments, the proximal surface of the bounding element is vertical.

In various embodiments, the proximal surface of the bounding element comprises an axially tapered surface with a maximum diameter at a proximal end thereof nearest to the impellor.

In certain embodiments, the repelling blades are fixed to an outer surface of a male element surrounding and rotationally fixed to the impellor shaft between the proximal surface of the bounding element and the impellor, the repelling blades being circumferentially spaced apart about the outer surface of the male element, the male element having a tapered diameter that is largest at a proximal end thereof nearest to the impellor.

In some embodiments, the repelling blades are straight. And in other embodiments the repelling blades are curved.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
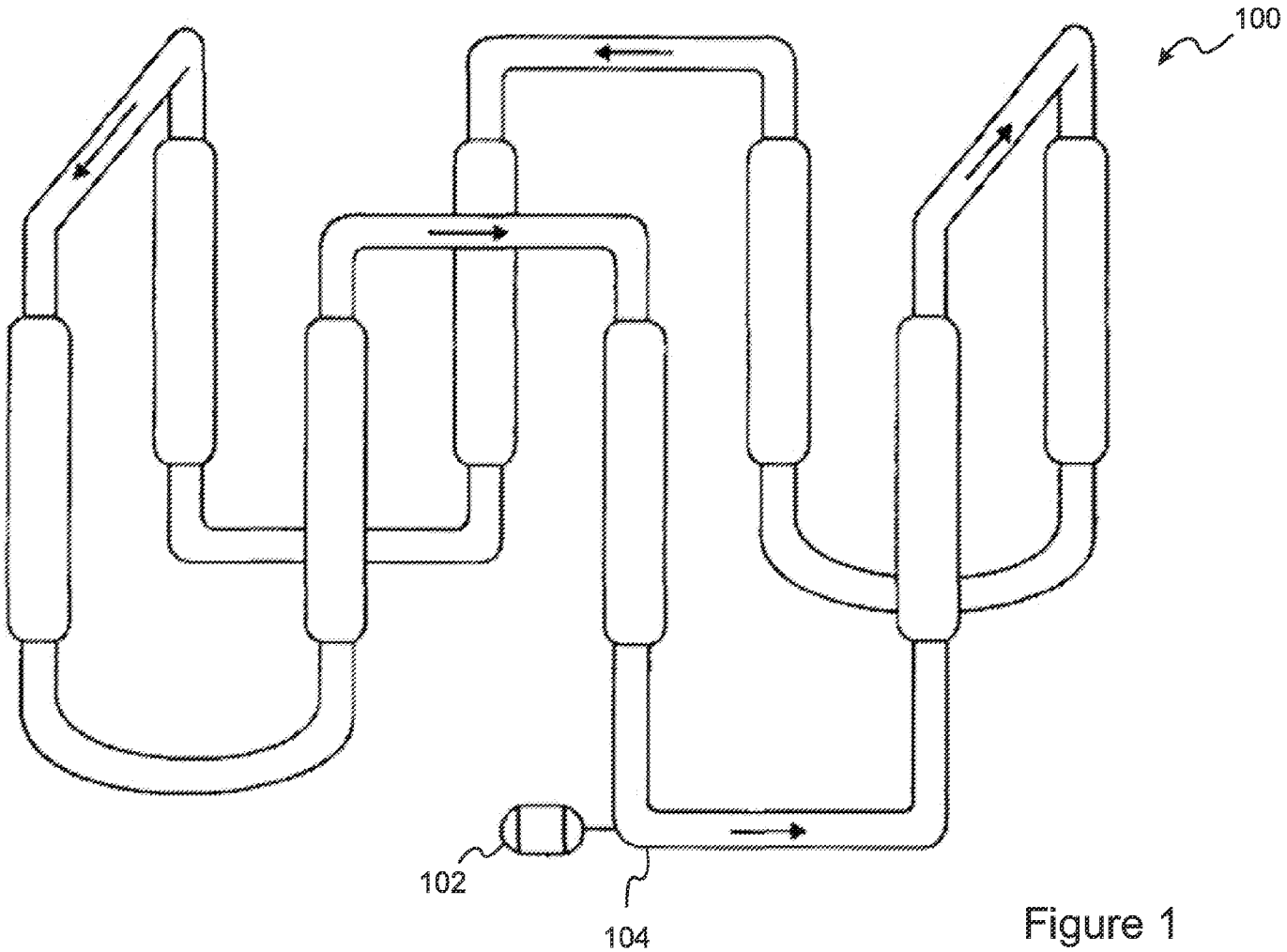
Figure 1 Prior Art
FIG. 1 is perspective view of a loop reactor system of the prior art.
Figure 2:
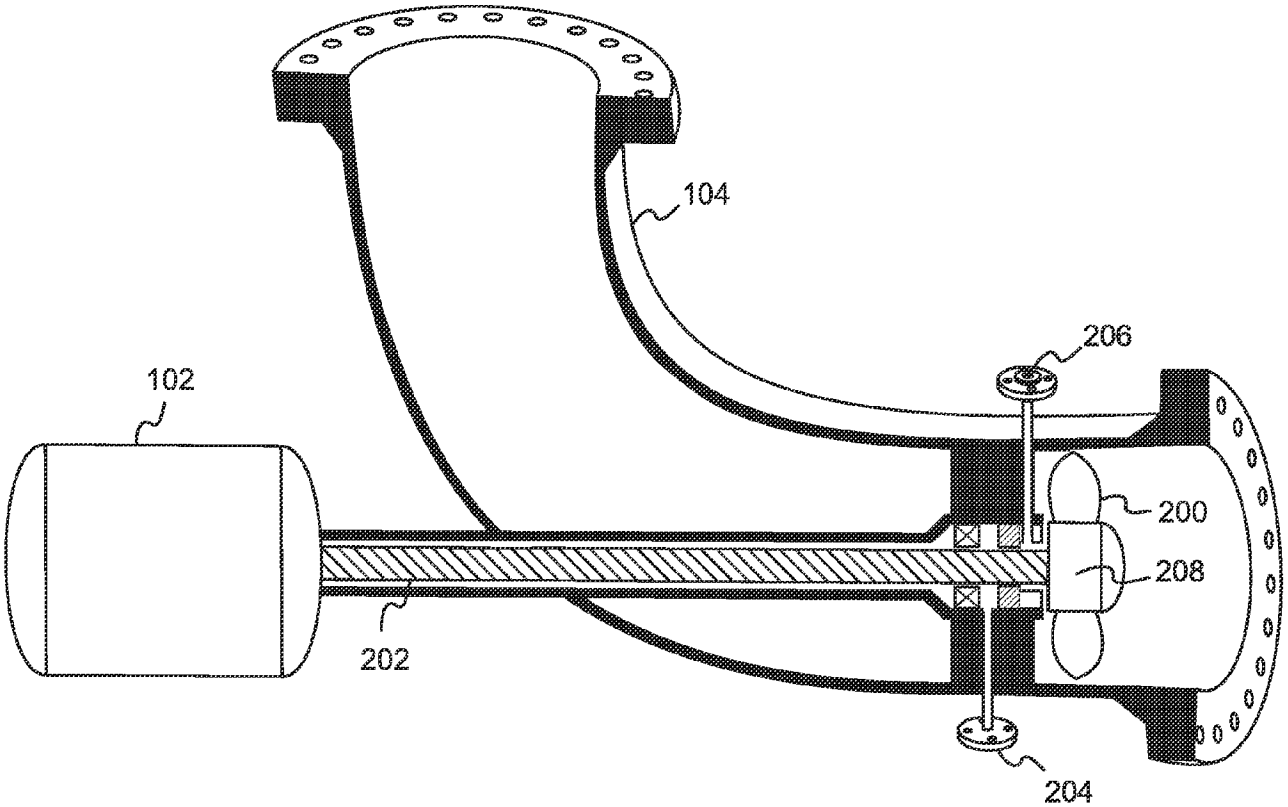
Figure 2 Prior Art
FIG. 2 is cut-away side view of an axial pump installed in an elbow section of a loop reactor of the prior art.
Figure 3:
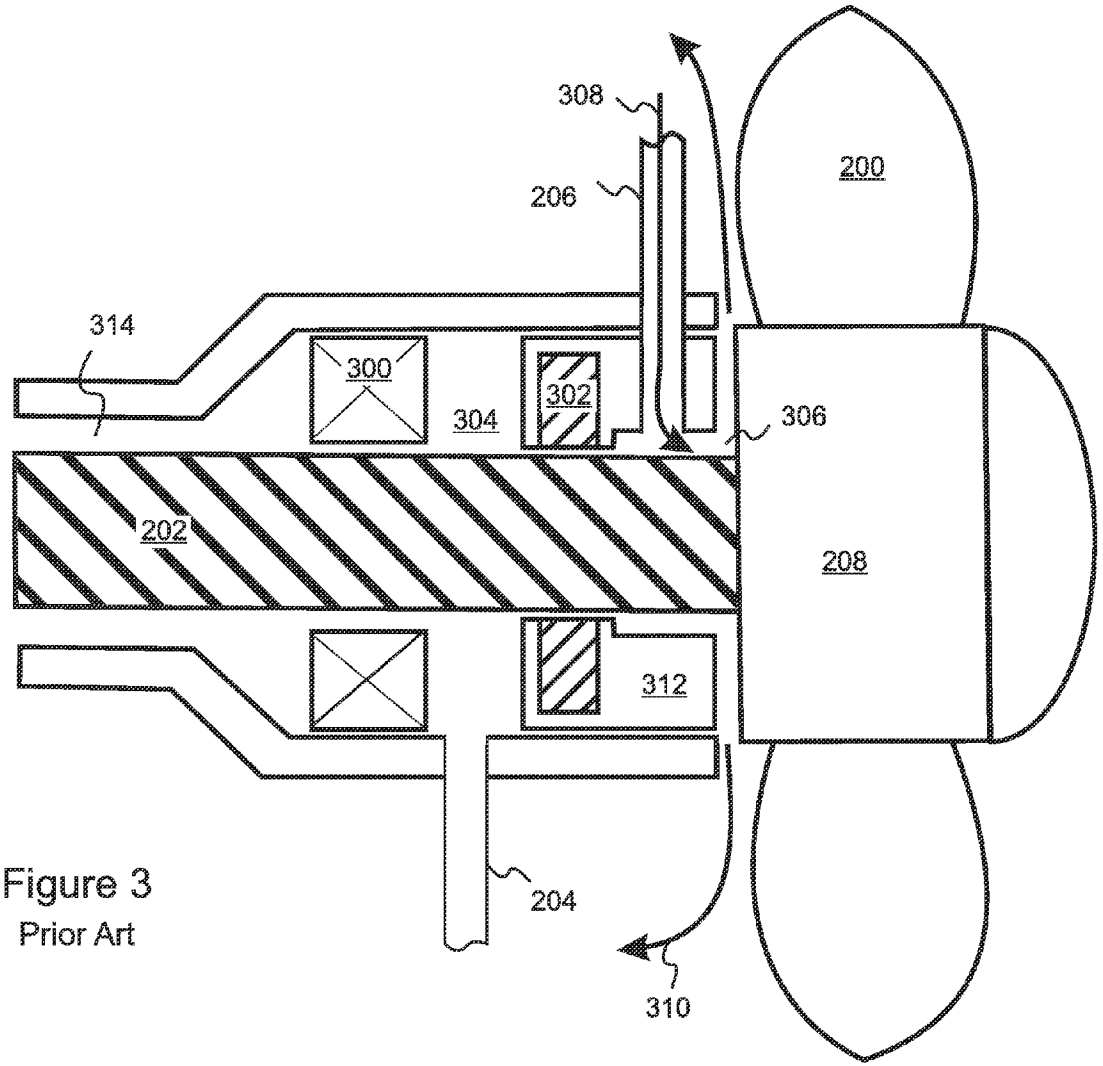
Figure 3 Prior Art
FIG. 3 is a close-up cut-away side view of the impellor, seal, and bearing region of the axial pump of FIG. 2, showing a flow of flushing fluid during normal operation.
Figure 4:
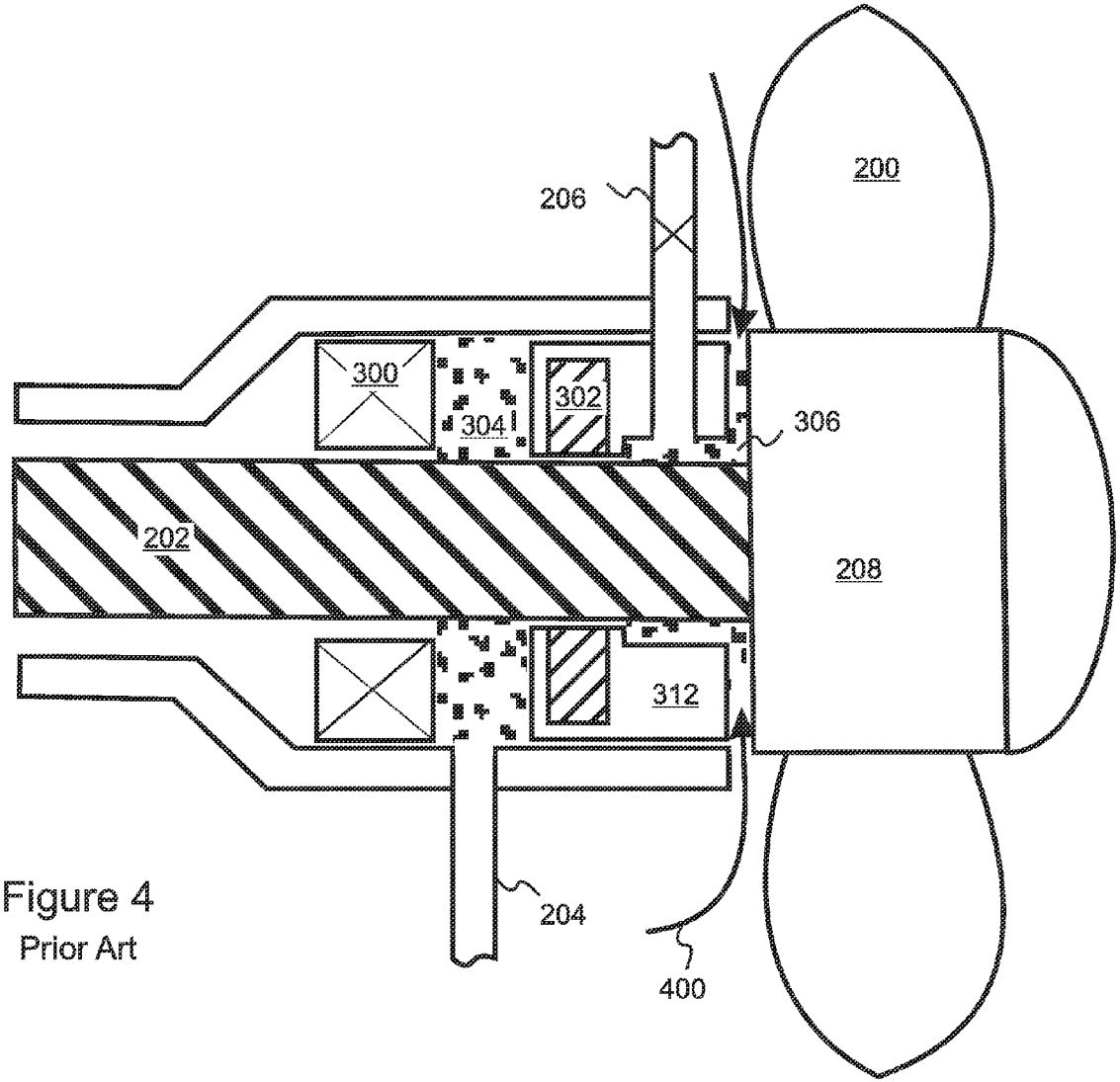
Figure 4 Prior Art
FIG. 4 is a close-up cut-away side view of the pump region of FIG. 3, showing entry of polymer solids into the space between the bearing housing and the impellor when the flushing process is interrupted.
Figure 5A:
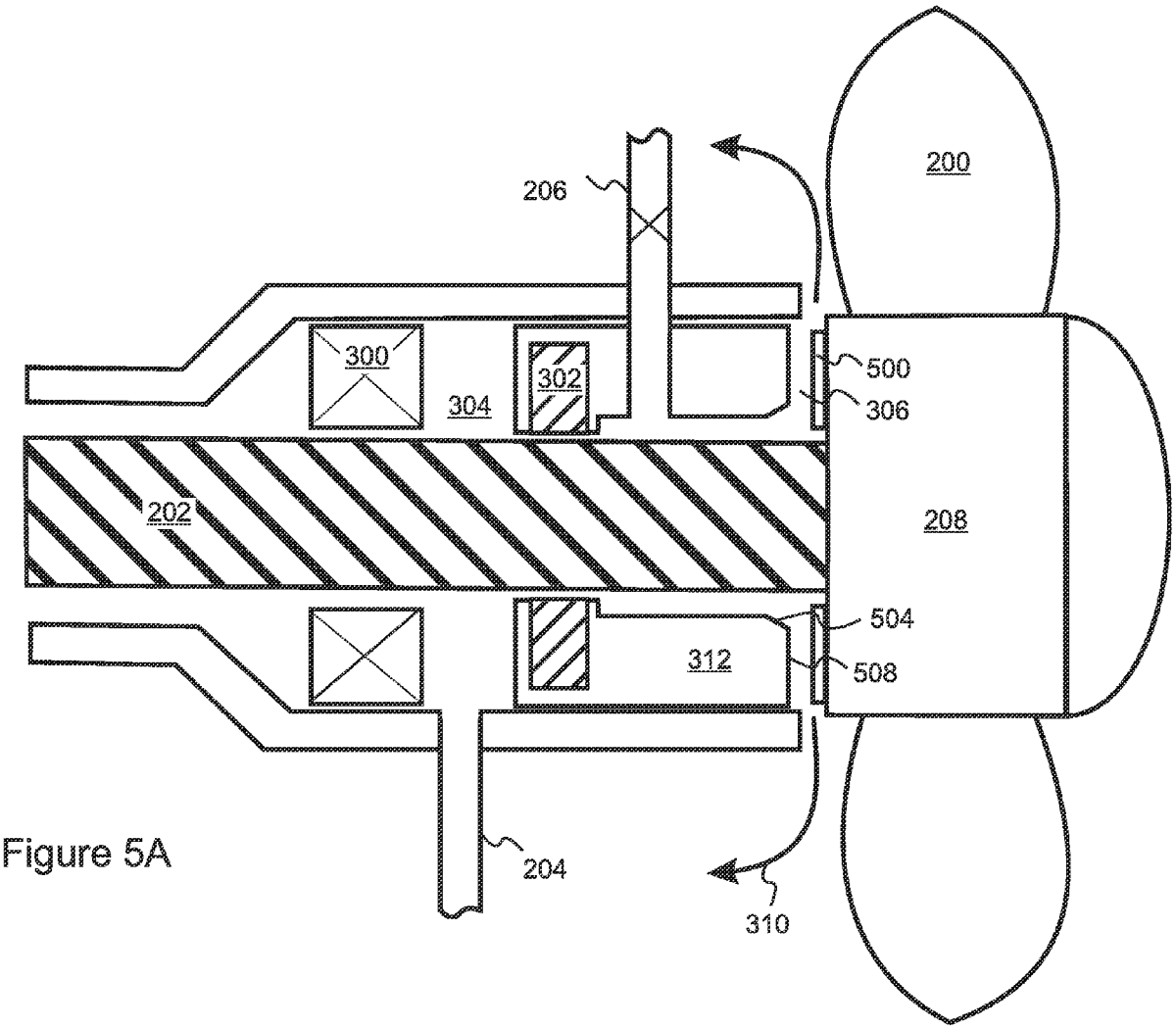
FIG. 5A is a close-up cut-away side view of the impellor, seal, and bearing region of an embodiment of the present invention wherein the repelling blades are fixed to a vertical rear surface of the impellor hub.

The present invention is a mechanical expelling mechanism for an axial pump system in a loop reactor. With reference to FIG. 5A, the mechanical expelling mechanism includes repelling vanes 500 that are rotationally synchronized with the impellor hub 208 and are configured to circulate fluid in a space between the impellor hub 208 and a bounding wall 504 provided by the proximal side 508 of the adjacent seal housing 312. In combination, these elements exclude and eject process slurry, especially polymer solids, away from the seals 302 and bearings 300. The repelling vanes 500 further serve to circulate and exchange any process fluid and catalyst that remains in the space between the impellor hub 208 and the proximal surface 508 of the seal housing 312, so that localized warming and run-away formation of polymer solids is avoided.

In embodiments, the seal housing includes a proximal side wall 508 which is either partly or entirely vertical and flat. In other embodiments the proximal side wall of the seal housing 508 comprises an inwardly tapered surface 504 that directs centrifugally circulating fluid and polymer solids away from the seals 302 and toward the main flow of the process slurry. The inwardly tapered surface 504 can include only an inner portion of the seal housing proximal side wall 508, as shown in FIG. 5A, or the entire proximal side wall 508 of the seal housing can be tapered inward 504, as illustrated in FIGS. 5B and 5C.

Figure 5B:
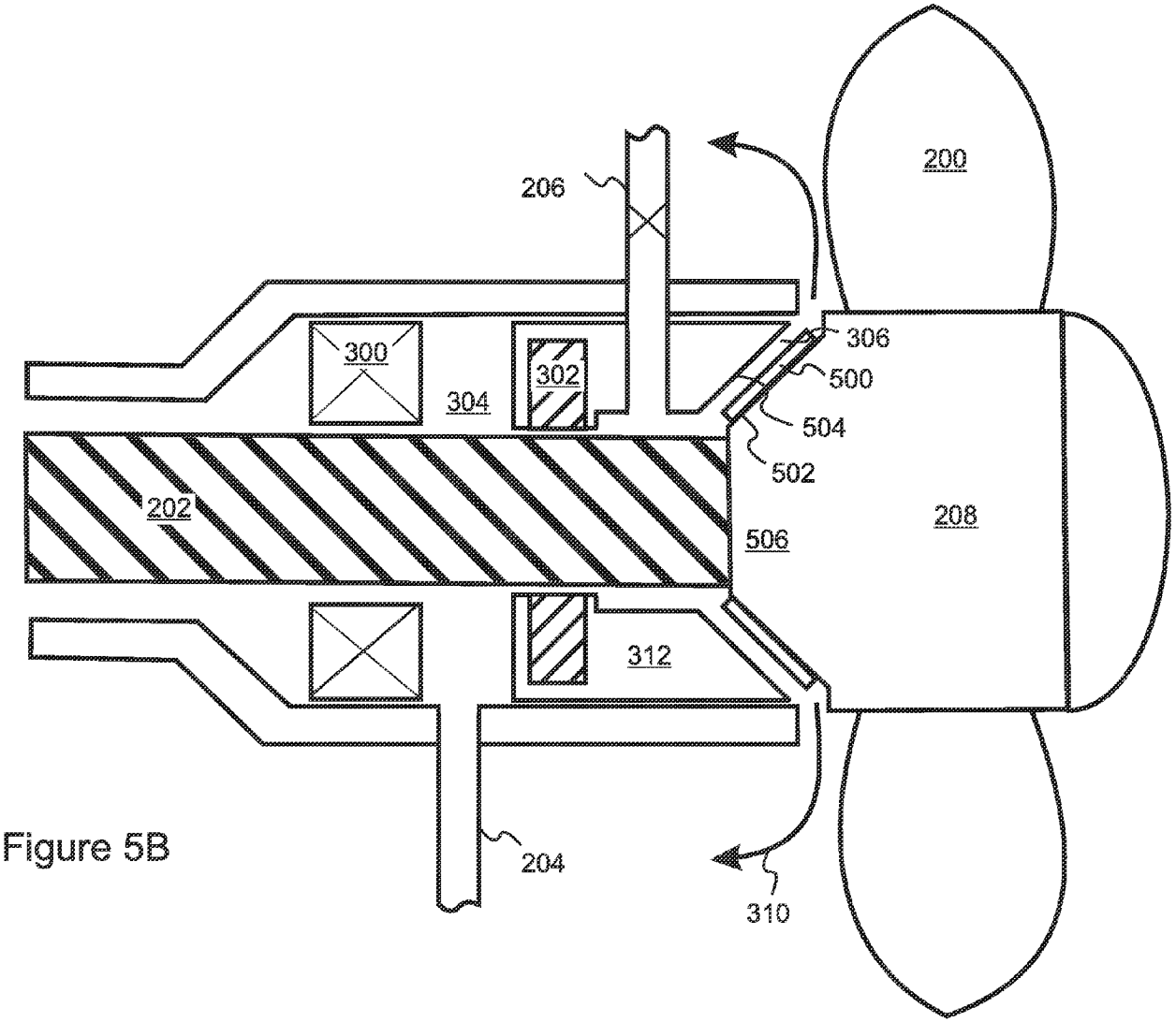
FIG. 5B is a close-up cut-away side view of the impellor, seal, and bearing region of an embodiment of the present invention wherein the repelling blades are fixed to a flat rear surface of the impellor hub that is tapered toward the seal housing.
Figure 5C:
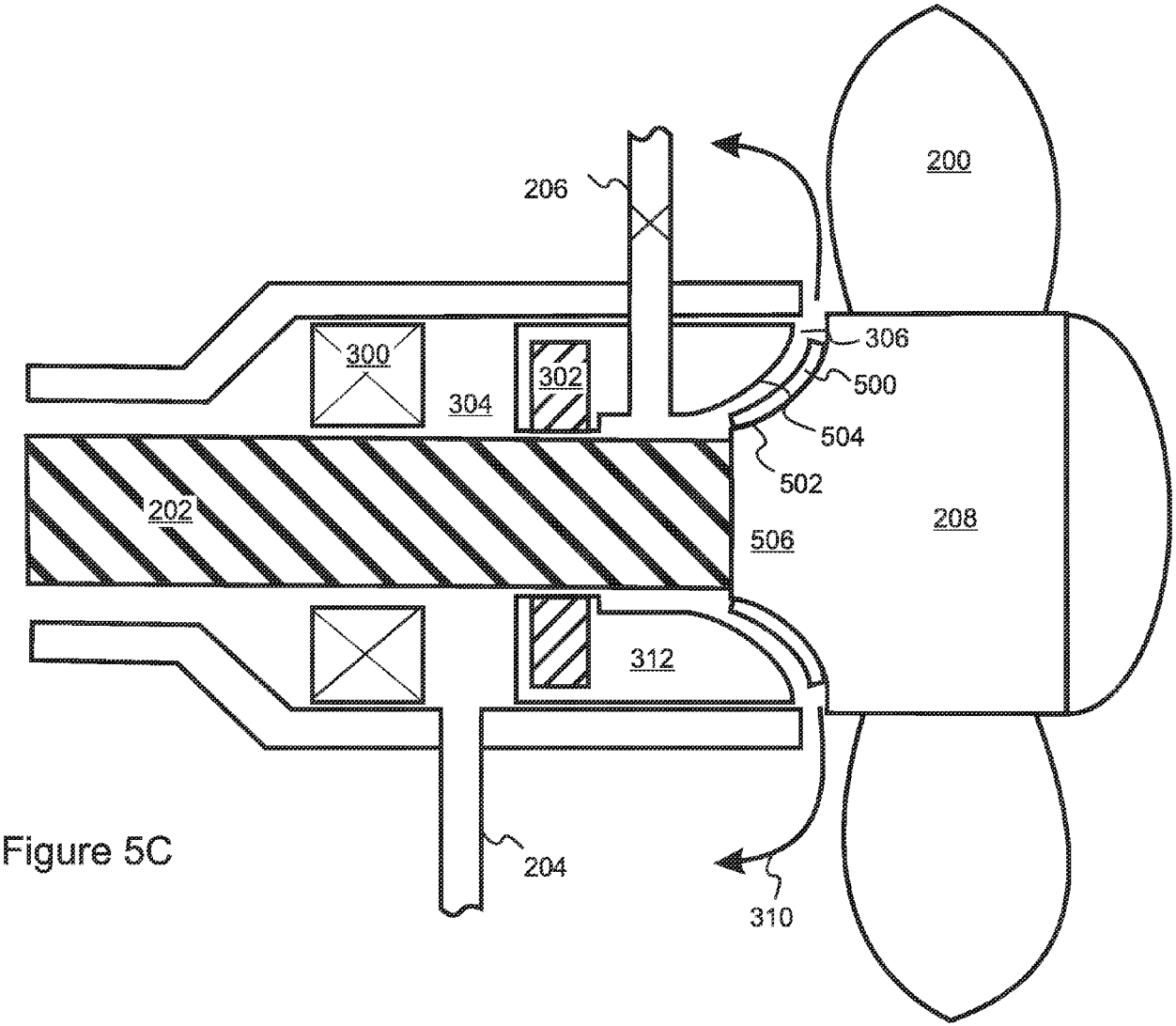
FIG. 5C is a close-up cut-away side view of the impellor, seal, and bearing region of an embodiment of the present invention wherein the repelling blades are fixed to a curved rear surface of the impellor hub that is tapered toward the seal housing.

In the embodiment of FIG. 5A, the repelling vanes 500 are vertical, and are fixed to a vertical rear face of the impellor hub 208, while in the embodiments of FIGS. 5B and 5C, the repelling vanes 500 are fixed to a tapered surface 502 of a male tapered element 506 that fills most of the space between the impellor 200 and the seal housing 312. In the embodiments of FIGS. 5B and 5C, the male tapered element 506 is a tapered rear portion of the impellor hub 208. In similar embodiments, the male tapered element 506 is a section of the impellor shaft 202, or a separate element attached to the impellor shaft 202. The tapered surface 502 of the male tapered element 506 can be straight, as shown in FIG. 5B, or curved, as shown in FIG. 5C where the curved tapered surface 502 approximates a parabolic shape.

In various embodiments, such as the embodiments shown in FIGS. 5B and 5C, the outer tapered surface 502 of the male element 506 has a shape that is complementary to the tapered inner surface 504 of the seal housing 312. This approach avoids the formation of "stall" areas in the space 306 between the seal housing 504 and the impellor hub 208 where the slurry is not rapidly exchanged. Due to the ongoing chemical reaction in the process fluid, if stall areas are allowed to form, there may be a danger that localized heating will occur that could lead to run-away formation of solids near the seal(s) 302. In these embodiments, the tapered shape of the outer surface 502 of the male element 506 minimizes the size of the fluid-containing space 306 between the impellor 200 and the seal housing 312, and prevents the formation of stall areas in this space 306 where localized heating and run-away solids formation can occur.

If the mechanical expelling mechanism of the present invention is used in combination with a traditional, pressurized flushing system that circulates catalyst-free flushing fluid through a flushing tube 206 or along the impellor shaft and into the seal housing, and if the flushing fluid remains available to the system even if it loses its pressurization, due for example to a failure of a flushing pump or a leak in the system, then the mechanical expelling mechanism of the present invention will effectively function as a centrifugal flushing pump that will continue to circulate flushing fluid through the seal housing 312 and into the main flow of the process slurry, at least until the pressurized flushing system can be restored to normal operation.

On the other hand, if the present invention is implemented without a traditional pressurized flushing system, or if a pressurized flushing system is provided but the flushing fluid is blocked or otherwise unavailable due to some failure, then the mechanical expelling mechanism of the present invention will nevertheless operate to exclude polymer solids from the seals and bearings due to two separate mechanisms. First, the repelling vanes 500 will physically eject polymer solids away from the seals 302 and out into the main flow of the process slurry. Second, the repelling vanes 500 will force the fluid near the seals 302 to rapidly circulate and exchange with the fluid in the main process flow, so that localized heating due to the ongoing chemical reaction and run-away formation of solids near the seals 302 will be avoided.

In embodiments, the mechanical expelling mechanism of the present invention reduces the pumping efficiency by less than 1%.

Figure 6:
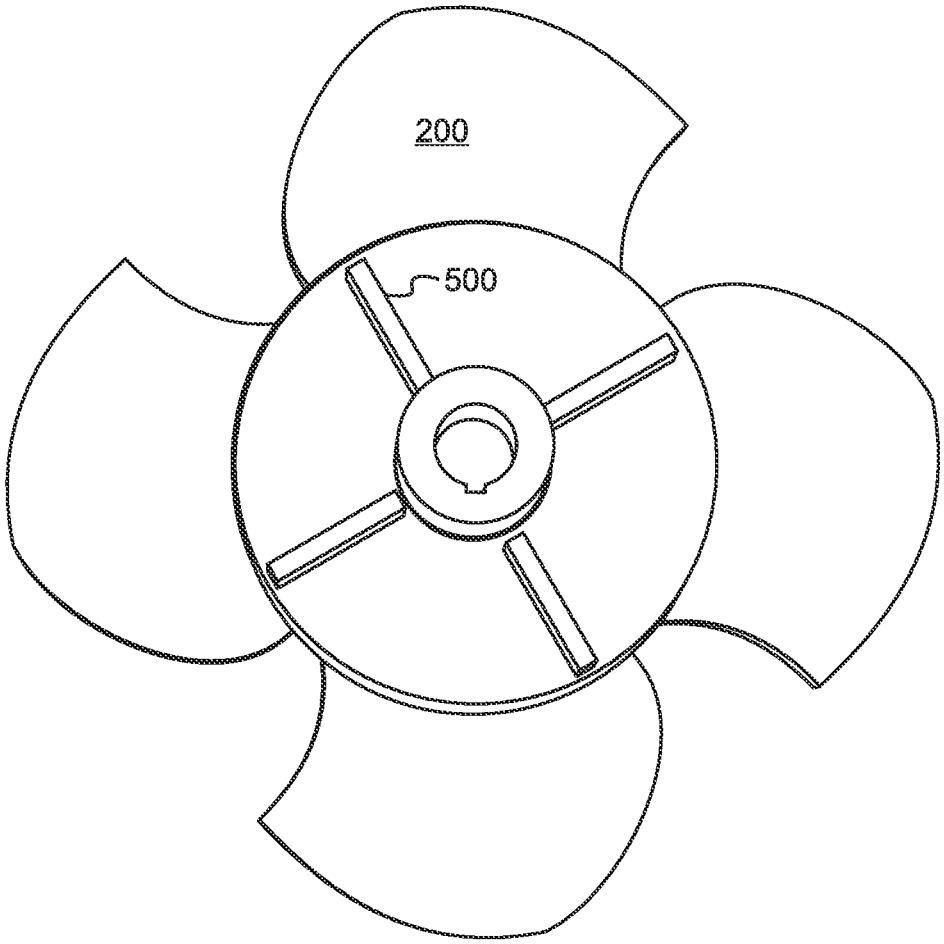
FIG. 6 is a rear perspective view of an impellor that has straight repelling vanes in an embodiment of the present invention.
Figure 7:
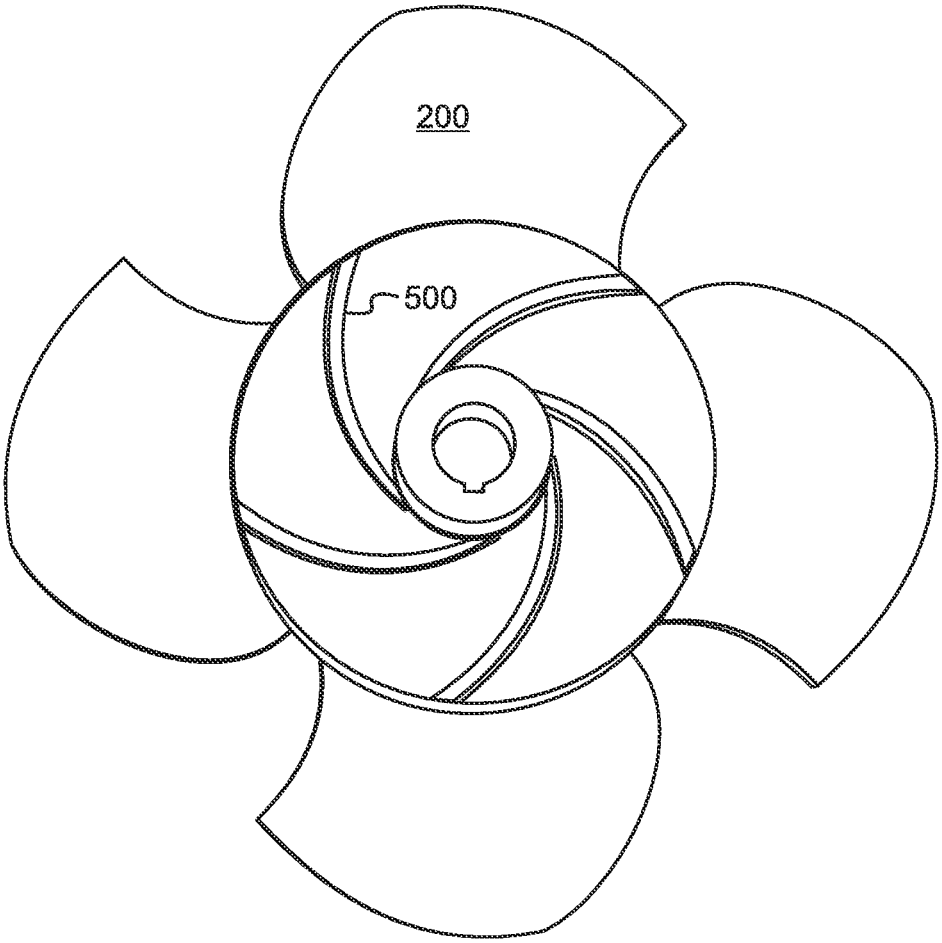
FIG. 7 is a rear perspective view of an impellor that has curved repelling vanes in an embodiment of the present invention.

The repelling vanes 500 of the present invention have different shapes in different embodiments. FIG. 6 is a rear perspective view of an impellor in an embodiment of the present invention where the repelling vanes 500 are straight. FIG. 7 is a rear perspective view of an impellor in an embodiment of the present invention where the repelling vanes 500 are curved.

While embodiments of the present invention are sometimes described herein as including a vertically flat 508 and/or inwardly tapered face 504 of the seal housing 312, and repelling vanes 500 on a vertical or tapered rear face 502 of the impellor hub 208, it should be understood that any combination of elements that provides the mechanical configuration and functionality described herein falls within the scope of the invention. For example, the repelling vanes 500 can be vertical and fixed to a vertical rear surface of the impellor hub 208, as shown in FIG. 5A, or they can be fixed to a tapered outer surface of a male element surrounding the impellor shaft 202 adjacent to the rear face of the impellor hub 208. If a tapered male element is included, it can be a rearward extension of the impellor hub 208, as shown in FIGS. 5B and 5C, or it can be a separate, tapered male element that is attached to the impellor shaft 202 just behind the impellor hub 208. It should also be understood that the vertically flat 508 and/or inwardly tapered wall 504 that abuts or surrounds the repelling vanes 500 need not be provided by the seal housing 312, but can be provided by a separate piece or by appropriate configuration of some other element in the system.

Note that the term "tapered curve" is used herein to describe any curve that has a monotonically varied amplitude above a longitudinal axis, with a maximum at one end and a minimum at the other end. Similarly, the term "tapered surface" is used herein to describe the three-dimensional shape that is formed when a tapered curve is rotated about its longitudinal axis.

It should further be understood that the present invention is not limited to axial pumps 102, nor to polymer loop reactors 100, but includes any style of pump having an impellor that is exposed to a process fluid in which solids are present and/or being formed in the fluid by a chemical reaction.

Similarly, the invention is not limited to any particular type of bearings, but can include ball bearings, sleeve bearings, or any other type of suitable bearings, or any combination thereof, and any appropriate type of lubrication. Accordingly, the terms "bearing" and "seal" are used generically herein to refer to any suitable types and quantities of bearings and seals. Also, the terms refer to both the singular and the plural, depending on the embodiment. In other words, the terms "bearings" and "seals" do not imply that a plurality of bearings or seals is provided in all embodiments, nor do the terms "bearing" and "seal" imply that only one bearing or one seal is included in all embodiments.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

I claim:

1. A system for inhibiting process solids from entering a protected region of a pumping apparatus, the system comprising:

an impellor shaft;

an impellor surrounding and rotationally fixed to the impellor shaft;

a protected region located proximal to the impellor shaft behind the impellor;

a male element surrounding and rotationally synchronized with the impellor shaft between the protected region and the impellor, an outer surface of the male element having a tapered diameter that is largest at a proximal end thereof nearest to the impellor;

a female element surrounding the impellor shaft between the protected region and the male element, an inner surface of the female element having a tapered diameter that is largest at a proximal end thereof nearest to the impellor, a flushing space being formed between the inner surface of the female element and the outer surface of the male element; and a plurality of repelling blades rotationally fixed to the outer surface of the male element and located within the flushing space, the repelling blades being circumferentially spaced apart about the outer surface of the male element and configured to centrifugally circulate process solids in the flushing space, so that the process solids are driven axially toward the impellor and away from the protected region.

2. The system of claim 1, wherein the protected region contains at least one of a seal and a bearing cooperative with the impellor shaft.

3. The system of claim 1, wherein the male element is a tapered rearward extension of the impellor.

4. The system of claim 1, wherein the male element is a tapered section of the impellor shaft.

5. The system of claim 1, wherein the male element is distinct from the impellor and from the impellor shaft.

6. The system of claim 1, wherein the female element is a section of a bearing housing containing a bearing that supports the impellor shaft.

7. The system of claim 1, wherein the female element is a section of a seal housing containing a seal configured to inhibit leakage of fluid between the seal and the impellor shaft.

8. The system of claim 1, wherein the system is able to exclude process solids from the protected region while the process solids are being formed in a reactive process fluid.

9. The system of claim 1, wherein the repelling blades are straight.

10. The system of claim 1, wherein the repelling blades are curved.

11. The system of claim 1, further comprising a flushing tube configured to inject a flow of flushing fluid into the flushing space so as to drive process solids away from the protected region, wherein the system is able to exclude process fluids from the protected region during a stoppage of the flow of flushing fluid.

12. The system of claim 11, wherein the system is able to prevent the process solids from damaging elements in the protected region during a stoppage of the flow of flushing fluid for a duration of at least 15 minutes.

13. The system of claim 11, wherein the system is able to prevent the process solids from damaging elements in the protected region during a stoppage of the flow of flushing fluid for a duration of at least 24 hours.

14. The system of claim 1, wherein the system does not require injecting a flow of flushing fluid into the protected region so as to prevent the process solids from damaging elements in the protected region.

15. The system of claim 1, wherein the process solids are contained within a polymer loop reactor.

16. A method for inhibiting process solids from entering a protected region of a pumping apparatus, the method comprising:

providing an impellor surrounding and rotationally fixed to an impellor shaft, a protected region being located proximal to the impellor shaft behind the impellor;

providing a plurality of repelling blades rotationally synchronized with the impellor and located between the impellor and the protected region;

providing a bounding element surrounding the impellor shaft between the protected region and the repelling blades, a flushing space being formed between a proximal surface of the bounding element and the impellor;

providing a flushing system configured to deliver pressurized flushing fluid into the flushing space; and during a pressure loss of said flushing system, causing the impellor shaft to rotate, thereby rotating the repelling blades and causing flushing fluid to be circulated from the flushing system through the flushing space, so that the process solids are driven away from the protected region.

17. The method of claim 16, wherein the repelling blades are vertical.

18. The method of claim 16, wherein the proximal surface of the bounding element is vertical.

19. The method of claim 16, wherein the proximal surface of the bounding element comprises an axially tapered surface with a maximum diameter at a proximal end thereof nearest to the impellor.

20. The method of claim 16, wherein the repelling blades are fixed to an outer surface of a male element surrounding and rotationally fixed to the impellor shaft between the proximal surface of the bounding element and the impellor, the repelling blades being circumferentially spaced apart about the outer surface of the male element, the male element having a tapered diameter that is largest at a proximal end thereof nearest to the impellor.

21. The method of claim 16, wherein the repelling blades are straight.

22. The method of claim 16, wherein the repelling blades are curved.

23. A method for inhibiting excess formation of polymer solids within a protected region of an axial pump included in a polymer loop reactor, the method comprising:

providing an axial pump having an impellor surrounding and rotationally fixed to an impellor shaft and configured to create an axial flow of process fluid in the loop reactor from an upstream side of the impellor to a downstream side of the impellor;

providing a plurality of repelling blades rotationally synchronized with the impellor and located between the impellor and the protected region;

providing a bounding element surrounding the impellor shaft between the protected region and the repelling blades, a flushing space being formed between a proximal surface of the bounding element and the impellor, a peripheral boundary of said flushing space being in fluid communication with said axial flow of process fluid; and causing the impellor shaft to rotate, so that the repelling blades rotate and cause fluid within the flushing space to be exchanged with fluid in the axial flow of process fluid, thereby avoiding excess heating and excess formation of polymer solids within the protected region.

* * * * *